United States Patent [19]

Dorsey, Jr.

[11] 4,028,205

[45] June 7, 1977

[54] SURFACE TREATMENT OF ALUMINUM

[75] Inventor: Geoffrey A. Dorsey, Jr., Danville, Calif.

[73] Assignee: Kaiser Aluminum & Chemical Corporation, Oakland, Calif.

[22] Filed: Sept. 29, 1975

[21] Appl. No.: 617,550

[52] U.S. Cl. ..... 204/181; 148/6.27; 156/665; 252/79.5; 427/327; 427/409

[51] Int. Cl.[2] ..... C23F 7/06; C09K 13/02; C25D 13/00

[58] Field of Search ..... 148/6.27; 156/22, 23; 252/79.5; 204/181; 427/327, 409

[56] References Cited

UNITED STATES PATENTS

| | | | |
|---|---|---|---|
| 2,653,861 | 9/1953 | Meyer | 252/79.5 |
| 2,987,426 | 6/1961 | Shaw | 148/6.27 |
| 3,300,349 | 1/1967 | Tershin et al. | 252/79.5 |
| 3,356,550 | 12/1967 | Stiffler et al. | 156/22 |
| 3,437,598 | 4/1969 | De Voldre et al. | 252/79.5 |
| 3,488,228 | 1/1970 | Scott et al. | 148/6.27 |
| 3,497,440 | 2/1970 | Weigel | 204/181 |
| 3,544,391 | 12/1970 | Scott et al. | 148/6.27 |
| 3,557,000 | 1/1971 | Smith | 252/79.5 |

*Primary Examiner*—T. Tung

*Attorney, Agent, or Firm*—Paul E. Calrow; Edward J. Lynch

[57] ABSTRACT

This invention is directed to a method of pretreating an aluminum surface for the application of paint, adhesives and the like comprising subjecting the surface to the high temperature action of an alkaline solution containing a nonionic or anionic surface active wetting agent which retards the etching of the aluminum surface by the caustic solution.

13 Claims, No Drawings

SURFACE TREATMENT OF ALUMINUM

BACKGROUND OF THE INVENTION

This invention generally relates to an improved method of preparing an aluminum surface for the application thereto of curable organic matter, such as paints or adhesives.

Over the years, many processes have been described for pretreating an aluminum surface in preparation for subsequent painting, adhesive bonding and the like. Most of these processes fall into one of two classifications, namely, chemical conversion coating or anodizing. Although anodized coatings can be excellent bases for paints and adhesives, generally, they are two expensive for most commercial applications. As a result, only chemical conversion coatings have been used to any significant extent in commercial practice, particularly in continuous coil coating operations. Chemical conversion coating processes for aluminum usually involve utilization of a highly acidic solution containing one or more species of chromates (primarily dichromates) frequently fluorides and/or phosphates and various types of accelerators such as ferricyanides. Conventional chemical conversion coating solutions usually contain proprietary products, such as Alodine 1200, Alodine 401-45, Bonerite 78 and the like. These commercial products form coatings which are excellent bases for paints and adhesives. For example, painted aluminum products with a conventional chemical conversion coating base have been subjected up to twenty years or more of outdoor exposure with no serious detrimental effects.

Increased concern of late about environmental pollution has resulted in legislation which severely restricts what chemicals can be discarded into waterways and local sewage treatment facilities. Such restrictions now usually require the complete treatment of spent chemical conversion coating solutions to remove therefrom the undesirable chromates, fluorides, phosphates, cyanides and the like prior to discharge. Treatment of the spent solutions usually include passing the solution through ion exchange resins in addition to other treatments which increase considerably the cost and complexity of chemical conversion coating processes. This is particularly evident in continuous coil coating operations where large volumes of chemicals are employed.

Efforts have been made to reduce the amount of chromates, fluorides and phosphates in the chemical conversion coating solutions, but the quality of resultant painted products is frequently less than satisfactory. In U.S. Pat. No. 3,488,228 and U.S. Pat. No. 3,531,332, a process is described wherein an aluminum surface is treated with an aqueous solution of certain amines which generate a pH between 7 and 11. Improved adhesion between the aluminum substrate and organic coatings, such as paint or adhesive, is alleged. One of the stated advantages is that no chromates or fluorides are used in the treating solution. However, to date no significant commercial use has occurred of such conversion coatings or any other coatings employing no chromates, fluorides or phosphates as a paint or an adhesive base has occurred to date.

It is against this background that the present invention was developed.

DESCRIPTION OF THE INVENTION

The invention is directed to a readily controllable process for forming a hydrophilic coating on an aluminum surface which develops a tenacious bond with curable organic matter, such as paints and adhesives. Moreover, the solution used in the process contains no chromates, fluorides, phosphates or other deleterious compounds which are difficult to dispose of without special treatment. Control of the process solution is relatively simple. The invention is highly useful in continuous coil coating lines, particularly those lines wherein a primer coat is electro-deposited from a water-based paint bath.

In accordance with the invention, the aluminum workpiece is treated for a relatively short period of time with a hot caustic alkali solution containing small effective quantities of a nonionic or anionic surfactant to form an aluminum oxide coating which develops a tenacious bond with paints, adhesives and the like. The aluminum oxide coating formed is believed to contain pseudoboehmite-type aluminum oxide which provides the improved adhesive properties.

The concentration of the surfactant ranges from about 0.001 to about 1%, preferably about 0.01 to 0.50%, by weight. A broad spectrum of surface-active wetting agents can be utilized in the present process. Generally nonionic or anionic types of surfactants are preferred with the nonionic type being most desirable. Use of the terms "nonionic+ or "anionic" refers to the fact that the surfactant is nonionic or anionic under conditions of treatment.

Suitable surfactants include condensation products of ethylene oxide and propylene oxide with alkyl, aryl or alkylaryl alcohols, esters, ethers, and carboxylic acids; sulfonated alkyl, aryl, or alkylaryl compounds; and alkyl, aryl or alkylaryl phosphates or phosphonates. Most commercially available surfactants are mixtures of various components and can have many functions other than as a wetting agent. Moreover, it is recognized that a single surfactant component may have many diverse functional groups. For example, nonionic and anionic functional groups may exist on the same molecule.

Generally, the surfactant is somewhat soluble or at least dispersible in water and stable in the treatment solution at the temperature and pH described. The surfactant generally acts as a wetting agent, and, in addition thereto, it is believed that the surfactant is sorbed onto the surface being treated, thereby retarding the dissolution thereof by the alkaline solution. In the present process, some dissolving of the aluminum or aluminum oxide surface must occur to effect the desired coating, but the dissolution is considerably less, i.e., less than 25%, preferably less than 10%, of the etching normally experienced in an alkaline solution at the prescribed pH and temperature of the invention. Surfactants which generate significant amounts of long chain aliphatic carboxylate anions ($C_{10}$–$C_{20}$) in the treatment solution are not desired because the long chain carboxylate anions tend to react with the aluminum or aluminum oxide surface to form a coating which is hydrophobic, not hydrophilic as in the present case.

The pH of the aqueous solution should range from about 8.5–10.0, preferably 9.5 ± 0.5, which is maintained by a caustic alkali, such as sodium, potassium or lithium hydroxide. The solution should be relatively free of impurities, and, preferably contains less than 0.0001% by weight fluorides, chlorides and nitrates. However, the water utilized to make up the solution need not be purified (e.g., deionized, distilled, etc.). For example, tap water can usually be employed. The alkaline solution can be buffered by the addition of soluble borate, phosphate, carbonate, acetate and sulfate salts, preferably alkali metal salts of sodium, potassium and lithium. For ease of control, the surfactant should not be consumed by the etching reactions of the treatment.

The solution temperature is from about 50° C up to and including the boiling point of the solution, preferably from about 75°–95° C. Although the treating solution is described herein as being at elevated temperatures, it is recognized that the temperature at the interface between the metal surface and the alkaline solution is the most important and generally must fall within the ranges set forth above. If desired, the aluminum surface can be at elevated temperatures, e.g., greater than 50° C and the solution can be at a temperature less than 50° C, e.g., room temperature, provided that the interface temperature is within the aforesaid requisite range. The treatment times of the invention are quite short, generally from less than 1 second, e.g., from 0.1 second up to about 1 minute, which make the process attractive for applications in continuous coil coating operations. Extended treatment times, e.g., greater than 1 minute, tend to form a smut on the treated surface which may detrimentally affect the subsequent application of paint or adhesives. However, this smut can be readily removed by treatment in a conventional fashion with a 50% nitric acid solution.

Before treating the aluminum surface in accordance with the invention, the surface should be cleaned by way of vapor degreasing, solvent rinsing, immersion in an inhibited alkaline cleaning solution or another equivalent means.

The hydrophilic oxide coating formed in the alkaline solution of the invention is quite thin, usually on the order of 100 angstrom units in thickness, making a complete analysis of the coating quite difficult. No significant amounts of carbonaceous matter have been found in the oxide coating. However, the presence of the requisite aluminum oxide coating is readily determined by testing with No. 600 Scotch brand tape sold by the 3M Corporation. In testing, the tape is pressed onto the dried, treated surface and then rapidly removed. Presence of the requisite coating is indicated by cohesive failure of the tape which leaves significant amounts of adhesive from the tape on the treated surface when the tape is rapidly removed.

A hot caustic solution with a pH of 8.5–10 pH will normally etch the aluminum surface, but with the addition of a small effective amount of surfactant in accordance with the invention, the etching is retarded so that the desired oxide coating is formed. Etching of an aluminum surface with a highly alkaline solution is normally characterized by the evolution of large amounts of hydrogen from the surface. However, when the surfactant of the invention is present in such a bath, the evolution of hydrogen from the solution is significantly reduced. The dissolution rate of the surface being treated in the present process is less than 25%, preferably less than 10%, of the dissolution rate of an aqueous solution at the same pH and temperature but without the surfactant.

An aluminum oxide coating having some pseudoboehmite-type aluminum oxide is well known to provide a tenacious bond with curable organic matter, such as paints or adhesives, but most of the prior art methods for forming this type of coating have been very expensive. See, for example, U.S. Pat. Nos. 3,675,801 and 3,714,625 (anodizing) of the present inventor and U.S. Pat. No. 2,973,674 (heat treatment) to Bugosh. In contrast, the present process is rapid, inexpensive and effective.

As used herein, aluminum refers to pure aluminum, commercially pure aluminum and aluminum alloys containing more than 50% by weight aluminum. All references to percent composition herein are weight percent unless noted otherwise.

The following examples are provided to further illustrate the invention.

EXAMPLE 1

Cleaned 3105 aluminum alloy panels (Aluminum Association alloy designation) were treated for 30 seconds on an aqueous solution of sodium hydroxide containing about 0.2% Tergitol NPX, a nonionic surfactant sold by the Union Carbide Company. The pH of the solution was about 9.5 (NaOH conc. about 2 mg/liter) and the temperature was about 90° C. The treated panels were rinsed with deionized water, dipped in a 50% nitric acid solution to desmut, again water rinsed and then air dried. After treatment, the sheets were tested with No. 600 Scotch brand cellophane tape and in each instance a heavy tape adhesive residual was left on the aluminum surfaces when the tape was rapidly removed, indicating that the desired coating had been formed. The treated sheets were painted with a single coat (0.85 mil thick) of Canadian Pittsburgh Industries low gloss white Duracron 100 acrylic paint and cured in a conventional fashion.

EXAMPLE 2

A second group of clean 3105 aluminum alloy panels were prepared and tested in the manner set forth above in Example 1. The treated panels were electrocoated with a paint primer RF-2874A sold by PPG, Incorporated, top coated with Canadian Pittsburgh Industries low gloss white Duracron 100 acrylic paint (0.99 mil total thickness) and then both coats were cured in a conventional manner simultaneously.

EXAMPLE 3

A third group of clean 3105 aluminum alloy sheets were treated with an aqueous solution of Alodine 1200 sold by the Amchem Corporation so as to form a chemical conversion coating thereon of approximately 25 milligrams/ft$^2$. After rinsing and drying, the sheets were painted with a single coat (0.84 mil thick) of Canadian Pittsburgh Industries low gloss white Duracron 100 acrylic paint and cured in a conventional manner.

EXAMPLE 4

A fourth group of clean 3105 aluminum alloy panels were treated in an aqueous solution of Alodine 401-45 sold by the Amchem Corporation so as to form a chemical conversion coating thereon of about 25 milligrams/ft$^2$. After rinsing and drying, the panels were electrocoated with RF-2874A paint primer sold by PPG, Inc., topcoated with Canadian Pittsburgh Industries low gloss white Duracron 100 acrylic paint (0.96 mil total thickness) and then both coats were cured in a conventional manner simultaneously.

The panels described above in Examples 1 through 4 were subject to Water Fog tests (Method 6201 of Federal Test Method 141), Salt Fog test (ASTM Test Method B117), CASS test (ASTM Method B-368-65), SWAACT (Navy Ship Specs. AA-A-00250/20) and ASFC test — Acidified Salt Fog Cyclic test (Military Specifications MIL-A-897A). After testing, the panels were rated with a rating of 10 (no effect) to 2 (large-scale corrosion). The results of these are set forth in the table below.

| | Example No. | | | |
|---|---|---|---|---|
| | 1 | 2 | 3 | 4 |
| Water Fog, 1000 hrs. | 10 | 10 | 10 | 10 |
| Salt Fog, 1000 hrs. | 10 | 10 | 10 | 10 |
| ASFC, 150 hrs. | 8 | 9 | 9 | 9 |
| ASFC, 300 hrs. | 7 | 8 | 8 | 8 |
| SWAACT, 100 hrs. | 4 | 8 | 6 | 8 |
| SWAACT, 200 hrs. | 2 | 7 | 4 | 7 |

Wedge bend and reverse impact tests were generally equivalent between the specimens of Examples 1 and 3 and specimens of Examples 2 and 4.

From the data above, it can be seen that the treatment of the invention is equivalent in almost all respects to a two-coat (ED primer) paint system with an Alodine 401-45pretreatment and almost as good as a single-coat paint system with an Alodine 1200 pretreatment. Treatment of spent solution is simple — merely neutralize.

EXAMPLE 5

A clean 3105 aluminum alloy sheet was treated in an aqueous solution containing about 0.2% of a nonionic surfactant which is essentially a nonyl phenyl polyethylene glycol ether sold under the brand name Tergitol NPX by the Union Carbide Company. The pH of the solution was about 9.5 (NaOH conc. about 2 mg/liter), and the temperature of the solution was about 85° C. Treatment time was about 10 seconds. After treatment, the sheet was rinsed, dried and then tape tested with No. 600 Scotch brand tape. The test was strongly positive indicating the desired coating had been formed.

EXAMPLE 6

A clean 3105 aluminum alloy sheet was treated in an aqueous solution containing about 0.2% of a nonionic surfactant which is essentially a nonyl phenoxy polyethyoxy ethanol sold under the brand name Triton N-101 by the Rohm & Haas Company. The pH of the solution was about 9.5 (NaOH conc. about 2 mg/liter), and the temperature of the solution was about 85° C. Treatment time was about 10 seconds. After treatment, the sheet was rinsed, dried and then tape tested as above. The test was strongly positive, indicating the desired coating has been formed.

EXAMPLE 7

A clean 3105 aluminum alloy sheet was treated in an aqueous solution containing about 0.2% of a nonionic surfactant which is essentially an alkylaryl polyether sold under the brand name Triton X-155 by the Rohm & Haas Company. The pH of the solution was about 9.5 (NaOH conc. about 2 mg/liter), and the temperature of the solution was about 85° C. Treatment time was about 10 seconds. After treatment, the sheet was rinsed, dried and then tape tested as above. The test was strongly positive, indicating the desired coating had been formed.

EXAMPLE 8

A clean 3106 aluminum alloy sheet was treated in an aqueous solution containing about 0.2% of tributyl phosphate, an anionic surfactant, sold by the Commercial Solvents Corporation. The pH of the solution was about 9.5 (NaOH conc. about 2 mg/liter), and the temperature was about 85° C. Treatment time was about 10 seconds. The sheet was rinsed, dried and then tape tested as above. The test was strongly positive, indicating that the desired coating had been formed.

EXAMPLE 9

A clean 3105 aluminum alloy sheet was treated in an aqueous solution containing about 0.2% of an anionic surfactant which is essentially dioctyl sodium sulfosuccinate dissolved in isopropyl alcohol, sold under the brand name Triton GR5 by the Rohm & Haas Company. The pH of the solution was about 9.5 (NaOH conc. about 2 mg/liter), and the temperature of the solution was about 85° C. Treatment time was about 10 seconds. After treatment, the sheet was rinsed, dried and then tape tested as above. The test was positive but considerably less than that of Examples 5–7.

EXAMPLE 10

A clean 3105 aluminum alloy sheet was treated in an aqueous solution containing about 0.2% of an anionic surfactant which is essentially dioctyl sodium sulfosuccinate dissolved in light oil, sold under the brand name Triton GR7 by the Rohm & Haas Company. The pH of the solution was about 9.5 (NaOH conc. about 2 mg/liter), and the temperature of the solution was about 85° C. Treatment time was about 10 seconds. After treatment, the sheet was rinsed, dried and then tape tested as above. The solution aggressively etched the surface of the aluminum sheet and the tape test was negative. Apparently, because the surfactant was dissolved in the light oil, a dilute emulsion was formed and insufficient amounts of surfactant were effectively present to retard the ethching.

EXAMPLE 11

A clean 3105 aluminum alloy sheet was treated in an aqueous solution containing 0.2% of the surfactant described in Example 6 and 0.4 gm/liter Na(OH) which was buffered to pH 9.5 by 9.5 gm/liter $N_2B_4O_7 \cdot 10H_2O$. The temperature of the solution was about 80° C and treatment time was 15 seconds. The treated sheet was rinsed, dried and then tape tested with No. 600 Scotch brand tape. The test was strongly positive indicating the desired coating had been formed.

It is believed that the coatings developed by the process described in U.S. Pat. No. 3,488,228 and U.S. Pat. No. 3,531,332 are similar to the coatings formed by the present process in that the treated surface gives positive results from the tape test; however, there is little or no description of the coating or the mechanism for providing improved adhesion. In the process described therein, the amine generates a desired solution pH between 7 and 11, and therefore, the amine component is consumed during surface treatment due to the etching of the surface. In a large continuous coil coating line, large amounts of the amine would thereby be consumed, in addition to that normally contained in the drag-out, and as a result, continual or very frequent monitoring and control of the amine content would be necessary. However, the present process requires the alkalinity to be generated by a caustic alkali (e.g., NaOH) which is considerably cheaper than the amines described. Moreover, by appropriate buffering, the solution pH control of the present process is simplified considerably because pH monitoring need not be continual or as frequent. The process described in the aforementioned patent requires use of purified water (e.g., deionized, distilled, etc.) for making up the treatment solution. In contrast, the present process can generally use tap water for solution make-up.

It is obvious that various modifications and improvements can be made to the present invention without departing from the spirit thereof and the scope of the appended claims.

What is claimed is:

1. A method of forming a hydrophilic oxide coating on an aluminum surface which facilitates the bonding thereto of curable organic matter comprising treating the aluminum surface with an aqueous alkaline solution consisting essentially of caustic alkali, a surfactant and the balance water, with the interfacial temperature between the aluminum surface and the treating solution ranging from about 50° C to the boiling point of the solution, the pH of the solution controlled by caustic alkali to more than 8 but less than 10 and the surfactant retarding the etching of the solution so as to effect the formation of the desired oxide coating which facilitates the bonding of the curable organic matter.

2. The method of claim 1 wherein the surfactant is selected from the group consisting of nonionic and anionic surfactants.

3. The method of claim 1 wherein the caustic alkali is selected from the group consisting of sodium hydroxide, potassium hydroxide and lithium hydroxide.

4. The method of claim 1 wherein the solution contains from about 0.0001 to 1% surfactant.

5. The method of claim 1 wherein the solution pH is buffered by an alkali metal salt selected from the group consisting of borate, carbonate, phosphate, acetate and sulfate.

6. The method of claim 1 wherein the interfacial temperature is about 75°–95° C.

7. The method of claim 1 wherein the pH of the solution is from about 9–10.

8. The method of claim 1 wherein the treatment time is less than 1 minute.

9. The method of claim 2 wherein the surfactant is selected from the group consisting of a. condensation products of ethylene oxide or propylene oxide with alkyl, aryl or alkylaryl alcohols, esters, ethers and carboxylic acids;
b. sulfonated alkyl, aryl or alkylaryl compounds; and
c. alkyl, aryl or alkyl aryl phosphates or phosphonates.

10. The method of claim 1 wherein the treated surface is coated with an organic material and cured.

11. The method of claim 10 wherein said organic material is paint.

12. The method of claim 10 wherein said organic material is an adhesive.

13. The method of claim 11 wherein the treated surface is electrocoated with a water-based primer coat, painted with a top coat and then both coats are cured simultaneously.

* * * * *

UNITED STATES PATENT OFFICE

CERTIFICATE OF CORRECTION

Patent No. 4,028,205 Dated June 7, 1977

Inventor(s) Geoffrey A. Dorsey, Jr.

It is certified that error appears in the above-identified patent and that said Letters Patent are hereby corrected as shown below:

Column 1, line 28, "Bonerite" should be -- Bonderite --.

Column 2, line 30, " "nonionic+" should be -- "nonionic" --.

Column 8, line 5, "0.0001" should be -- 0.001 --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*